US008858064B2

(12) United States Patent
McGuire et al.

(10) Patent No.: US 8,858,064 B2
(45) Date of Patent: Oct. 14, 2014

(54) PORTABLE HYDRODYNAMIC CAVITATION MANIFOLD

(75) Inventors: Dennis McGuire, Stuart, FL (US); Sanjeev Jakhete, Stuart, FL (US)

(73) Assignee: Ecosphere Technologies, Inc., Stuart, FL (US)

( * ) Notice: Subject to any disclaimer, the term of this patent is extended or adjusted under 35 U.S.C. 154(b) by 985 days.

(21) Appl. No.: 12/959,940

(22) Filed: Dec. 3, 2010

(65) Prior Publication Data

US 2011/0305104 A1 Dec. 15, 2011

Related U.S. Application Data

(63) Continuation-in-part of application No. 12/816,014, filed on Jun. 15, 2010, now abandoned.

(51) Int. Cl.
*B01F 5/06* (2006.01)

(52) U.S. Cl.
CPC ..... *B01F 5/0619* (2013.01)
USPC ..... 366/158.5; 366/336; 366/337

(58) Field of Classification Search
CPC ..... B01F 5/0618; B01F 5/0619
USPC ..... 366/158.5, 336, 337
See application file for complete search history.

(56) References Cited

U.S. PATENT DOCUMENTS

| | | | | |
|---|---|---|---|---|
| 3,643,927 | A * | 2/1972 | Crouch | 366/337 |
| 3,652,061 | A * | 3/1972 | Chisholm | 366/337 |
| 4,487,510 | A * | 12/1984 | Buurman et al. | 366/337 |
| 4,511,258 | A | 4/1985 | Federighi et al. | |
| 4,936,689 | A | 6/1990 | Federighi et al. | |
| 5,492,654 | A | 2/1996 | Kozjuk et al. | |
| 7,699,988 | B2 | 4/2010 | McGuire et al. | |
| 7,699,994 | B2 | 4/2010 | McGuire et al. | |
| 7,785,470 | B2 | 8/2010 | McGuire et al. | |

* cited by examiner

*Primary Examiner* — David Sorkin
(74) *Attorney, Agent, or Firm* — McHale & Slavin, P.A.

(57) ABSTRACT

A portable hydrodynamic cavitation manifold assembly formed from cylindrical tubes having flow-through chambers for collection and distribution of fluids. Each chamber includes a series of baffle units each unit formed from a first plate defined by a first end spaced apart from a second end by a length. The first plate includes a curved outer edge sized to follow the inner side wall of the chamber and a straight inner edge extending from the first end to the second end along the approximate center line of the chamber and positioned at a 45 degree angle relative to the longitudinal length of the tube. A second plate, forming a mirror image of the first plate, is also positioned at a 45 degree angle relative to the longitudinal length of the tube and at a 90 degree angle to the first plate. Each plate includes a plurality of apertures sized to control the velocity of the fluid flow, each aperture having edge walls to induce constriction for hydrodynamic cavitation mixing of fluids.

22 Claims, 4 Drawing Sheets

PORTABLE HYDRODYNAMIC CAVITATION MANIFOLD

PRIORITY CLAIM

This application is a continuation-in-part of U.S. patent application Ser. No. 12/816,014, filed Jun. 15, 2010, now abandoned the contents of which are incorporated herein by reference.

FIELD OF THE INVENTION

This invention relates to fluid handling and, more particularly, to a portable hydrodynamic manifold for use in providing a uniform fluid mixture at a Frac site.

BACKGROUND OF THE INVENTION

In-line fluid flow static mixers are known in the art and generally consist of mixing baffles arranged so that when a material is discharged from one baffle, it discharges with a swirling action and strikes the downstream baffle. The fluid flow divides before it passes on to the next succeeding baffle, which again divides the flow into various streams. While this type of mixer has achieved commercial success for mixing, use of a static mixer is ineffective with many high viscosity fluids. U.S. Pat. Nos. 4,511,258 and 4,936,689 disclose static mixer having a sinuous cross-section with each section being axially staggered with respect to another section, however, no teaching is made on presenting such a mixer to highly viscous materials.

In addition, such mixers would be economically unfeasible in situations wherein a high flow rate and rapid mixing is required.

Hydrodynamic cavitation is the result of a flow constriction wherein a liquid falls below the vapor pressure and forms vapor-filled gas bubbles. If the static pressure then increases and exceeds the vapor pressure, these vapor-filled gas bubbles collapse implosively. Cavitation and the associated effects are also known to be useful in mixing, emulsifying and dispersing various components in a flowing liquid. The mixing action is based on a large number of forces originating from the collapsing or implosion of cavitation bubbles. If during the process of movement of the fluid the pressure at some point decreases to a magnitude under which the fluid reaches a boiling point for this pressure, then a great number of vapor-filled cavities and bubbles are formed. Insofar as the vapor-filled bubbles and cavities move together with the fluid flow, these bubbles and cavities may move into an elevated pressure zone. Where these bubbles and cavities enter a zone having increased pressure, vapor condensation takes place within the cavities and bubbles, almost instantaneously, causing the cavities and bubbles to collapse, creating very large pressure impulses. The magnitude of the pressure impulses within the collapsing cavities and bubbles may reach ultra high pressures implosions leading to the formation of shock waves that emanate from the point of each collapsed bubble.

Hydrodynamic cavitation typically takes place by the flow of a liquid under controlled conditions through various geometries. The phenomenon consists in the formation of hollow spaces which are filled with a vapor gas mixture in the interior of a fast-flowing liquid flow or at peripheral regions of a fixed body which is difficult for the fluid to flow around and the result is a local pressure drop caused by the liquid movement. At a particular velocity the pressure may fall below the vapor pressure of the liquid being pumped, thus causing partial vaporization of the cavitating fluid. With the reduction of pressure there is liberation of the gases which are dissolved in the cavitating liquid. These gas bubbles also oscillate and the give rise to the pressure and temperature pulses.

It is known that devices exist in the art which utilize the passage of a hydrodynamic flow through a cylindrical flow-through chamber having a series of baffles confronting the direction of hydrodynamic flow to produce varied cavitation effects. The baffles provide a local contraction of the flow as the fluid flow confronts the baffle element thus increasing the fluid flow pressure. As the fluid flow passes the baffle, the fluid flow enters a zone of decreased pressure downstream of the baffle element thereby creating a hydrodynamic cavitation field. U.S. Pat. No. 5,492,654 discloses a cylindrical flow-through chamber having internally disposed baffles. In this disclosure the upstream baffle elements have a larger diameter than the downstream baffle elements. Such a device is utilized in an attempt to create and control hydrodynamic cavitation in fluids wherein the position of the baffle elements is variable.

Although the hydrodynamic cavitation devices exist in the prior art, there is nevertheless a need for improvement in many respects to provide a fluid shearing effect that allows for the mixing of fluids from multiple sources.

SUMMARY OF THE INVENTION

Disclosed is a hydrodynamic cavitation device incorporated into a manifold providing uniform mixing of fluids at a Frac site. The device is formed from cylindrical tubes having a flow-through chamber constructed and arranged to cause hydrodynamic cavitation of fluid drawn from various sources. The chamber includes a series of baffle units; each unit is formed from a first plate defined by a first end spaced apart from a second end by a length. The first plate includes a curved outer edge sized to follow the inner side wall of the chamber and a straight inner edge extending from the first end to the second end along the approximate center line of the chamber and positioned at a 45 degree angle relative to the longitudinal length of the tube. A second plate, forming a mirror image of the first plate, is also positioned at a 45 degree angle relative to the longitudinal length of the tube and at a 90 degree angle to the first plate. Each plate includes a plurality of apertures sized to control the velocity of the fluid flow, each aperture having edge walls to induce cavitation.

It is an objective of the instant invention to provide a portable static mixer capable of uniformly mixing fluid moving at a high velocity by use of hydrodynamic cavitation.

Another objective of the invention is to provide a manifold assembly to provide a balance of fluid draws in combination with uniform mixing of the fluids.

It is another objective of the instant invention to provide a portable hydrodynamic cavitation device which can operate at high mixing efficiencies and allow for receipt from multiple sources and deliver to multiple Frac tank systems.

It is an another objective of the instant invention to provide a hydrodynamic cavitation manifold having internal baffles positioned along alternating 45 degree angled plates allowing higher flow rates with predictable pressure losses.

It is yet another objective of the instant invention to provide a hydrodynamic cavitation device having angular positioning of baffles to provide for continuous flushing of suspended solids to prevent clogging.

These and other objectives and advantages of the present invention will become readily apparent as the invention is better understood by reference to the accompanying summary, drawings and the detailed description that follows.

DETAILED DESCRIPTION OF THE INVENTION

In many gas fields, gas is trapped in shale formations that require stimulating the well using a process known as fracturing or fracing. The fracing process uses large amounts of water and large amounts of particulate fracing material (frac sands) to enable extraction of the gas from the shale formations. After the well site has been stimulated the water pumped into the well during the fracing process is removed. The water removed from the well is referred to as flowback fluid or frac water. A typical fracing process uses millions of gallons of water to fracture the formations of a single well. Recycling of frac water has the benefit of reducing waste product, namely the flowback fluid, which will need to be properly disposed. On site processing equipment, at the well, is the most cost effective and environmentally friendly way of recycling this natural resource.

A horizontal well takes approximately 4.5 million gallons of fresh water for the fracture process. This water may be available from local streams and ponds, or purchased from a municipal water utility. The water is typically delivered to the well site by tanker trucks, which carry roughly five thousand gallons per trip. During flowback operations, approximately 300 tanker trucks are used to carry away more than one million gallons of flowback water per well for offsite disposal.

The Applicant has been awarded patents for unique processes that employ a cost-effective onsite cavitation reactor that combines ozone, hydrodynamic cavitation, ultrasound and electro-precipitation (see U.S. Pat. Nos. 7,699,994; 7,699,988; and 7,785,470 the contents of which are incorporated herein by reference).

Figure 1:
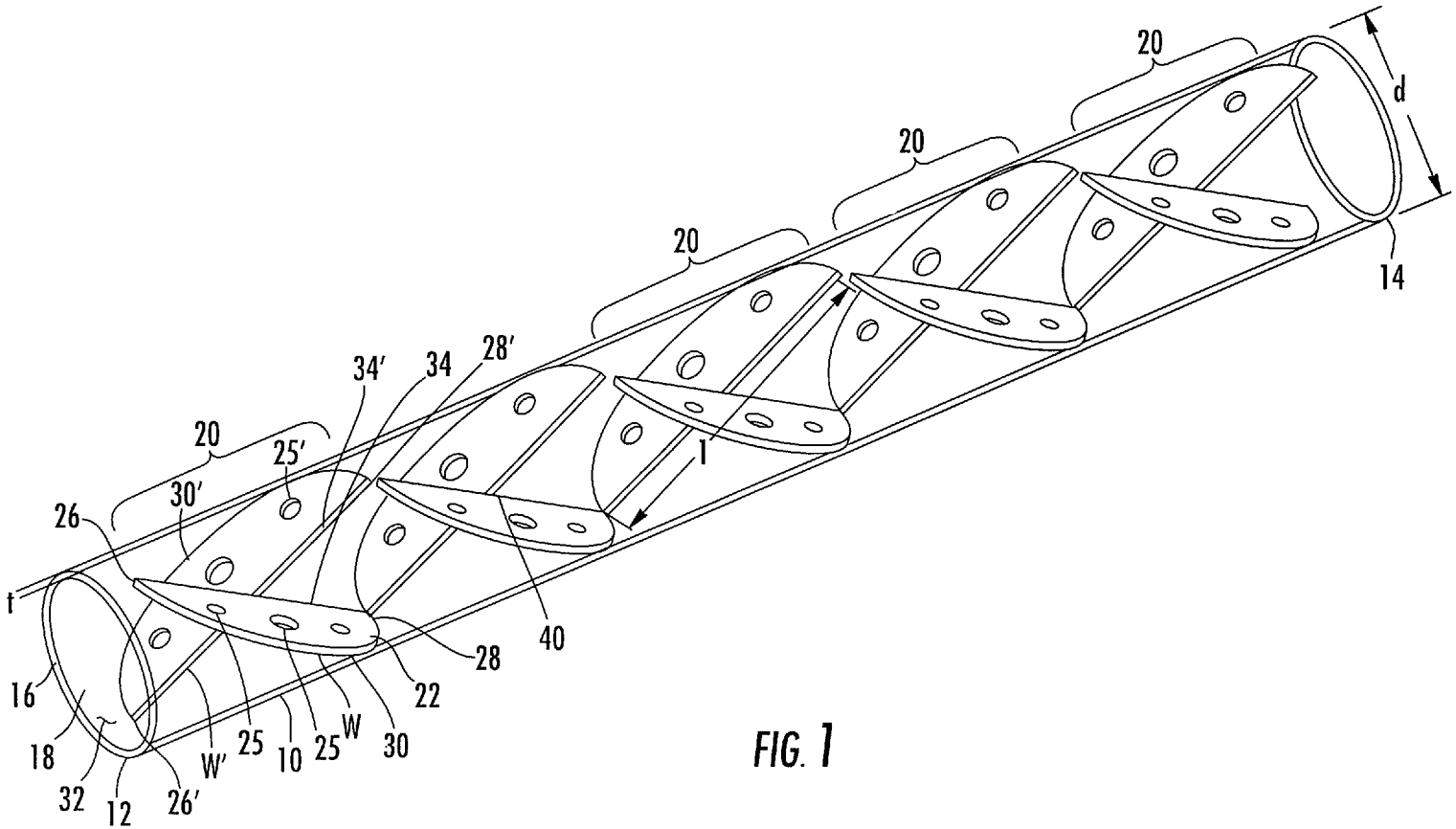
FIG. 1 is a cross-sectional side view of a hydrodynamic cavitation tube.

Referring now to FIG. 1, set forth is a cylindrical tube 10 having an inlet 12 and an outlet 14 with a continuous side wall 16 of thickness (t). The interior portion of the cylindrical tube forms a flow-through chamber 18 having a predetermined diameter (d). A first baffle unit 20 is positioned within the chamber and consists of a first plate' 22 and a second plate 24. The first plate 22 is defined by a first end 26 spaced from a second end 28 by a length (1) which is approximately twice the diameter of the chamber. The first plate has a width (w) which is approximately the same thickness (t) of the continuous side wall. The first plate is further defined by a curved outer edge 30, crescent shaped, sized to follow the inner side wall 32 of the cylindrical tube and has a straight inner edge 34 extending from the first end 26 to the second end 28 along the approximate center line of the cylindrical tube chamber 18. Apertures 25 are positioned in the plate in a predetermined size, number and position calculated to provide optimum cavitation with minimal pressure loss. Low iron content stainless steel, titanium, or certain thermoplastics is suitable for the high flow operation with minimal erosion of the plate edges.

The second plate 24 forms a mirror image of the first plate. For illustration the second plate is defined by a first end 26' spaced from a second end 28' by a length (1) which is approximately twice the diameter of the chamber. The second plate has a width (w) which is also approximately the thickness (t) of the continuous side wall. The second plate is further defined by a curved outer edge 30' sized to follow the inner side wall 32 of the cylindrical tube and has a straight inner edge 34' extending from the first end 26' to the second end 28' along the approximate center line of the cylindrical tube chamber 18.

The first plate 22 is positioned at a right angle (90 degrees) to second plate 24 along junction point 40. The junction point can be a weldment, pinion position, or be frictionally secured by use of an interference fit. The device for creating hydrodynamic cavitation in fluids according to claim 1 wherein each said plate includes a plurality of apertures. The apertures are flow thru and each includes a fluid orifice formed by the use of sharp edges that cause fluid passage so that each aperture is formed perpendicular to the plate and thus positioned at an angle to the fluid flow to create a constriction area.

The cross-sectional profile design creates the flow constriction area along the edges 34 and 34' and edges to apertures 25 and 25'. The shape edges on the exit side of each edge form vena contract eddys and fluid shearing. A high fluid flow velocity provides for a hydrodynamic cavitation field downstream of each baffle unit. The flow velocity in a local constriction is increased while the pressure is decreased, with the result that the cavitation voids are formed in the fluid flow past the baffle unit to form cavitation bubbles which create the cavitation field. The cavitation bubbles enter into the increased pressure zone resulting from a reduced flow velocity, and collapse. The resulting cavitation exerts a physico-chemical effect on the liquid.

The baffle units 20 are placed end to end with baffle units of mirror construction in a sinuous cross-section. The improvement over U.S. Pat. No. 4,511,258, the contents of which is incorporated herein by reference, is directed to the configuration of the baffles designed for high flow rates by use of strategically positioned flow thru apertures. Each aperture is sized to a plate and requires fixed certain diameter to match the length, width, and thickness of the plate, all of which are constructed and arranged to induce hydrodynamic cavitation by implosion of the cavitation induced increased pressure zone where coordinated collapsing occurs, accompanied by high local pressure (up to 1500 MPa) and temperature (up to 15,000 degree K.), as well as by other physico-chemical effects which initiate the progress of chemical reactions in the fluid that can change the composition of the mixture.

As the fluid flow passes from one baffle unit to a second, the low pressure may be created in a localized area of the fluid by the constriction of flow as the fluid flows therethrough. Hydrodynamic cavitation may also include collapsing the cavitation bubbles thereby producing local energy conditions like heating, high pressure that may lead to chemical bond breakage and partial oxidation of organic compounds. Collapsing the cavitation bubbles may occur in a zone or area of high or elevated pressure. it is believed that after a fluid flows through a local constriction, there may be an area downstream of the local constriction where cavitation bubbles are forming, completely formed cavitation bubbles are found may be called a cavitation field.

Cavitation bubbles generally contain gases and vapors. Collapsing the cavitation bubbles produce localized high energy conditions including high pressures and high temperatures requiring the baffles to be formed from a corrosive resistant material. When gases are present, high temperatures occur when the cavitation bubbles collapse and plasmas are created. The plasmas may emit ultraviolet light and the ultraviolet light may be emitted as pulses. Emission of this ultraviolet light may be called cavitation luminescence. The ultraviolet light may irradiate oxidizing agents contained within and/or associated with the cavitation bubbles. Irradiating oxidizing agents may produce ionization of the oxidizing agents. Irradiating oxidizing agents may produce hydroxyl radicals. The hydroxyl radicals may contact and/or react with organic compounds in a fluid or solution in which the cavitation bubbles are produced. These reactions may destroy or degrade the organic compounds, through breakage of chemical bonds within the compounds, for example. These reactions may produce partial oxidation of the organic compounds. These reactions may produce complete oxidation of the organic compounds, to carbon dioxide and water, for example. The fluid or solution that has been treated by the cavitation-based methods may be called a product of the methods.

Figure 2:
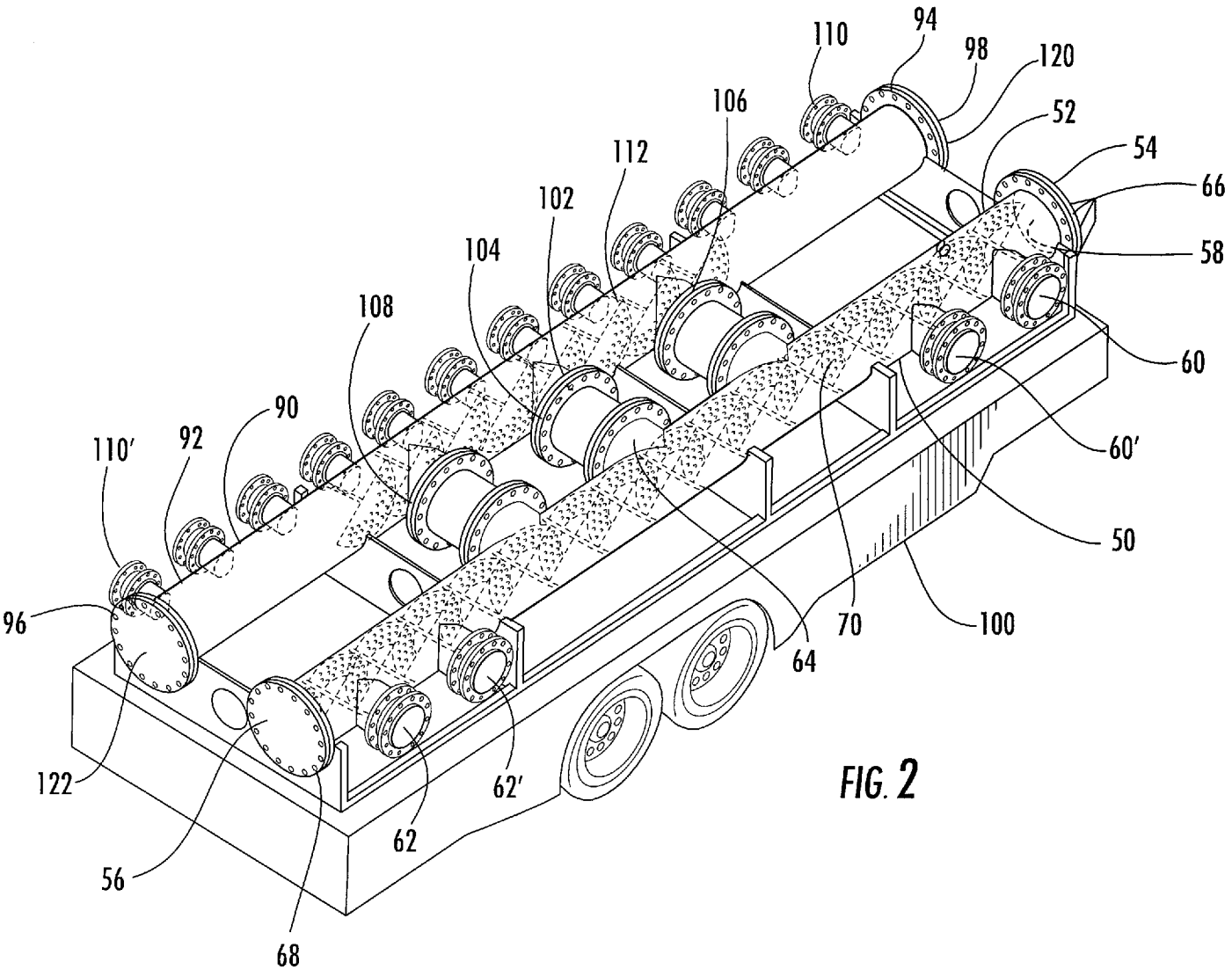
FIG. 2 is a top left perspective view of the mixing manifold of the instant invention.
Figure 3:
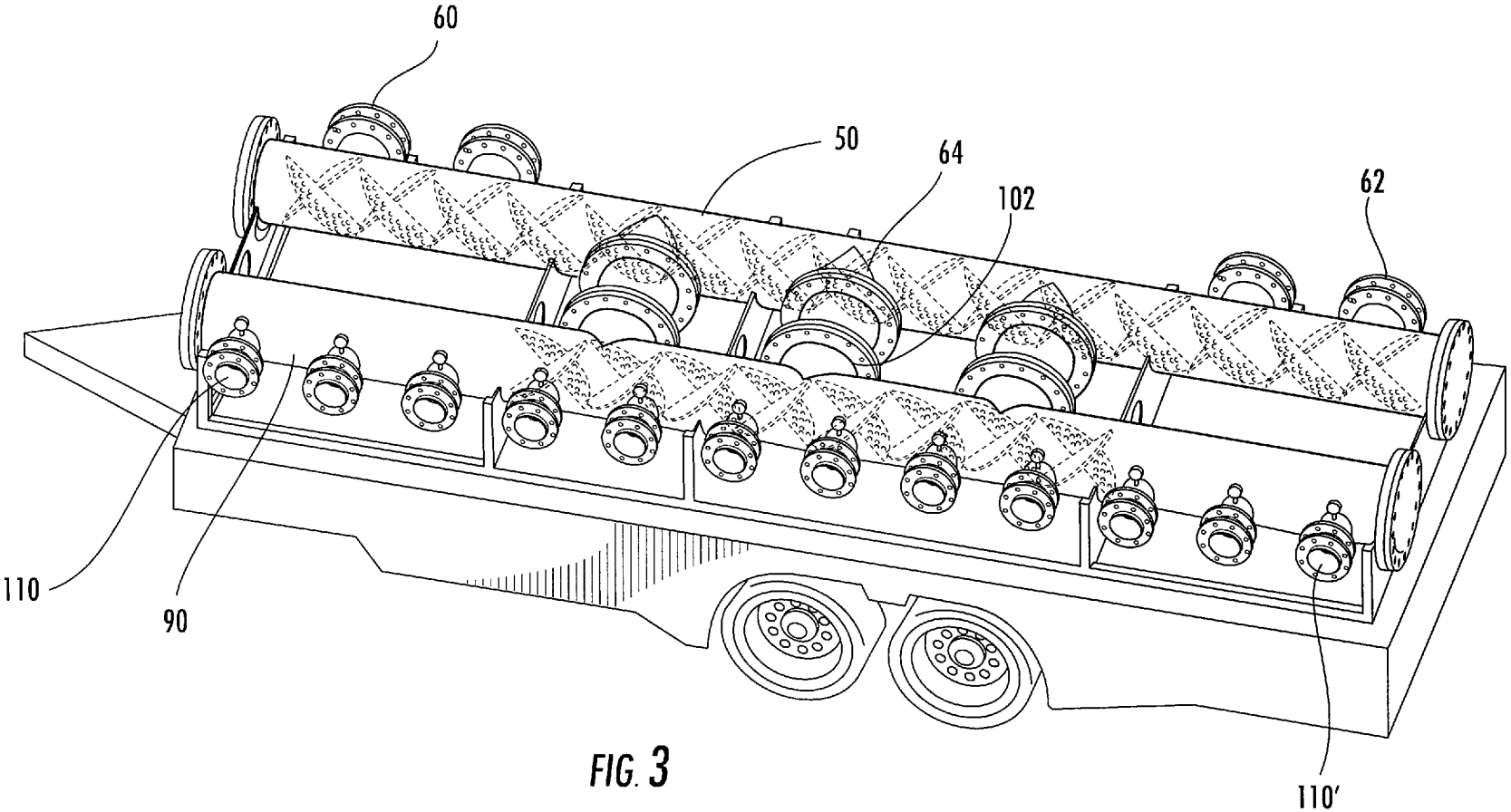
FIG. 3 is a top right perspective view of the mixing manifold.

FIGS. 2 and 3 illustrate the portable manifold system 100 of the instant invention having a collection housing 50 formed from a continuous sidewall 52 with a first end 54 and a second end 56 defining an interior chamber therebetween 58. The collection housing has a first inlet 60 through the sidewall which is juxtapositioned to the first end 54. A second inlet 62 placed through the side wall juxtaposition to the second end 56. For higher flows or in use with additional fluid sources a inlet 60' may be placed next to inlet 60' and inlet 62' positioned next to inlet 62.

A first baffle assembly 70 is positioned within the first chamber 58 and extends from the inlets 60 and 62 to an outlet 64. The baffle assembly is constructed from the previously mentioned crescent shaped plates.

A removable endcap 66 is coupled to the first end 54 and a second endcap 68 is coupled to a second end 56. The endcaps are sized to allow for the slidable insertion and removal of the first baffle assembly 70. The particular shape of the baffle units allow individual baffle units to be placed within the interior chamber without further securement, the shape prevents the baffle units from rotating and remain end to end. The baffle units consisting of a first and second crescent shaped plate.

A distribution housing 90 has a continuous sidewall 92 with a first end 94 and a second end 96 defining a second interior chamber 98 therebetween. The distribution housing 90 has an inlet aperture 102 fluidly coupled to the outlet 64 of the collection housing 50 by a coupling tube 104. While a single coupling tube may be suitable for low flows, in the preferred embodiment multiple coupling tubes 106 and 108 fluidly couple the collection housing 50 the distribution housing 90. The distribution housing 90 has a plurality of outlet apertures 110 which provide even distribution of fluids. In the preferred embodiment, each outlet aperture is sized to direct 10 barrels/minute of mixed fluid to an awaiting Frac tank structure.

A second baffle assembly 112 is positioned within the second chamber 98 and placed traverse to each inlet aperture 104. 106 and 108. The second baffle assembly is sized to polish the admixed solution before distribution through the outlets 98. A removable endcap 120 is coupled to one of the first 94 and a second endcap 122 is coupled to the second end 122 of the distribution housing 90 and are sized to allow for the slidable insertion and removal of the second baffle assembly 112. The use of the endcaps 120 and 122 allow for ease of baffle insertion during manufacturing and ease of removal should the baffles become clogged. It is noted that the fluid is introduced through the inlets perpendicular to the sidewall where fluid is first driven into the baffles at a transverse angle. The fluid flow is then along the length of the collection housing wherein the fluid that enter through the inlet is thoroughly mixed by itself or in combination with a second inlet flow 60' before entry into a coupling tube 104 wherein the fluid flow is directed at a 90 degree flow to the collection housing flow causing an admixing of fluids from the collection housing, namely fluids introduced through inlets 60, 60' and 62, 62'. The admixed fluid is delivered into the distribution housing again by a transverse fluid flow resulting in a homogenous fluid that is delivered through the outlets 110. The baffles further providing a uniform fluid pressure to inhibit short circuiting of flow that takes place in a conventional manifold. For instance, a conventional manifold could allow the fluid from inlet 62 to go directly to outlet 110' which eliminates the mixing of fluids from other sources and can quickly exhaust a Frac tank coupled to outlet 110'. In higher flow systems, multiple Frac tanks may be out of service thereby necessitating that the fluid flow is even distributed through the outlets but also have a homogenous solution so that predictably of frac tank service can be performed. In this manner each flow through aperture of the baffles can be sized to control the velocity of fluid flow through the housing and a predetermined pressure drop for a volume of fluid flow through can be predicted. Portability is accomplished by placement of the collection housing 50 and distribution housing 90 on a movable platform such as a flatbed vehicle 100.

Figure 4:
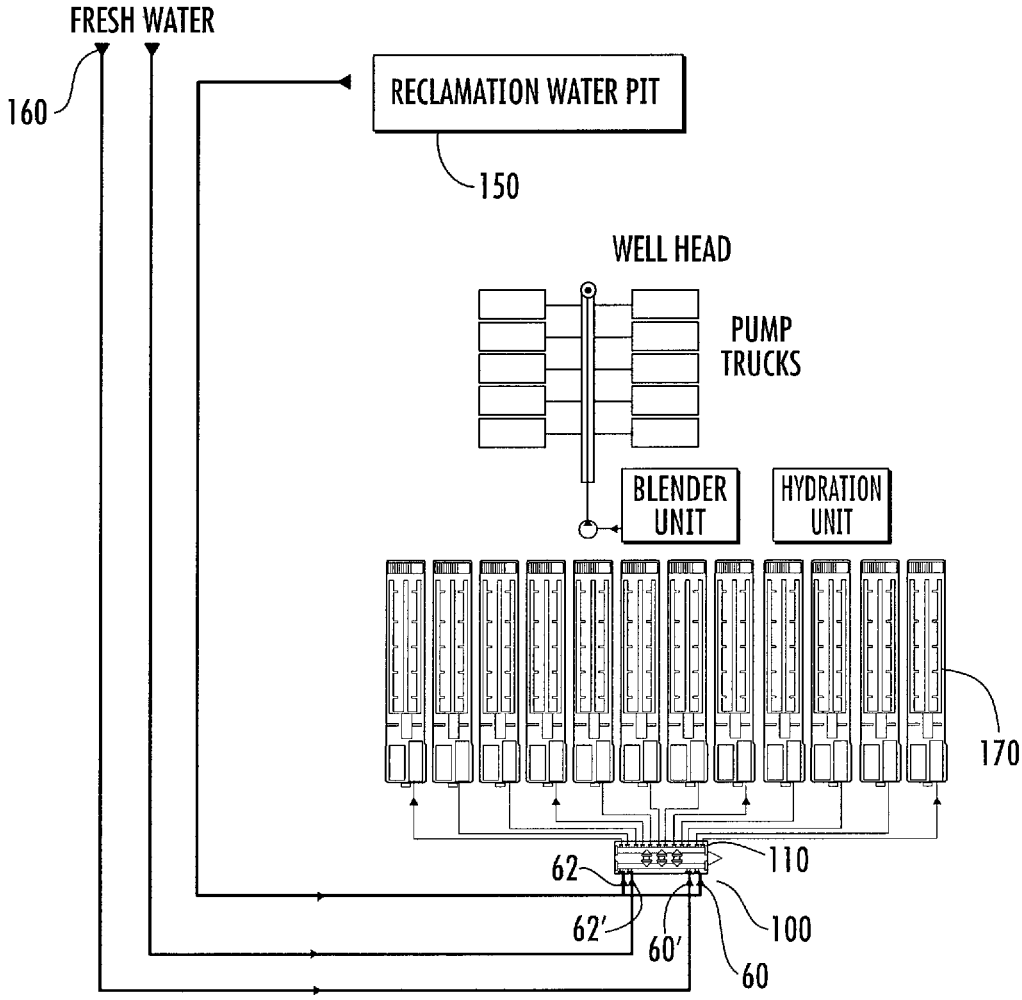
FIG. 4 is a pictorial view of the mixing manifold in a typical frac site.

Referring now to FIG. 4, by way of example shown is the portable hydrodynamic cavitation manifold system 100 in a typical frac site having inlet 60 and 60' receiving fluid from reclamation water pit 150 and inlet 62 and 62' receiving fluid from fresh water source 160. The fluids are mixed through the manifold and the outlets 110 are coupled to individual frac tanks 170 capable of handling 10 barrels/minute. While the illustration sets forth an example of twelve frac tanks coupled to the mixing manifold, it will be obvious to one skilled in the art the additional or less tanks may be employed with the collection and distribution housings sized accordingly.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A portable hydrodynamic cavitation manifold comprising:

a collection housing having a continuous sidewall with a first end and a second end defining a first interior chamber therebetween, said collection housing having at least one inlet through said sidewall juxtapositioned to said first end, at least one inlet through said side wall juxtaposition to said second end, and at least one outlet through said sidewall positioned between said first and second end;

a first baffle means positioned within said first interior chamber;

a distribution housing having a continuous sidewall with a first end and a second end defining a second interior chamber therebetween, said distribution housing having an inlet aperture fluidly coupled to said outlet of said collection housing and a plurality of outlet apertures;

a second baffle means positioned within said second interior chamber;

wherein fluid introduced through said inlet of said collection chamber is directed through said first baffle means for mixing independently, said independently mixed fluids are directed and admixed through said inlet aperture, said admixed fluid is directed through said second baffle means for mixing into a homogenous fluid and for distribution through said outlet apertures.

2. The portable hydrodynamic cavitation manifold according to claim 1 wherein each said baffle means is further defined as a first crescent shaped plate defined by a proximal end spaced apart from a distal end by a length approximately measuring twice the diameter of said first interior chamber, said first crescent shaped plate have a straight inner edge extending between said proximal and said distal end and a curved outer edge constructed and arranged to conform to an inner diameter of said first interior chamber, said first crescent shaped plate having a center width measuring approximately one half the diameter of the inner diameter of said first interior chamber and a second crescent shaped plate forming a mirror image to said first crescent shaped plate and positioned substantially perpendicular to said first crescent shaped plate; each said plate having at least one flow thru aperture constructed and arranged to form shear inducing angular shaped passageways through each plate.

3. The portable hydrodynamic cavitation manifold according to claim 2 wherein said straight inner edge is shaped to induce fluid shearing.

4. The portable hydrodynamic cavitation manifold according to claim 2 wherein each said flow through aperture is sized to control the velocity of fluid flow through said housing.

5. The portable hydrodynamic cavitation manifold according to claim 2 wherein each said flow through aperture is sized to provide a predetermined pressure drop for a volume of fluid flow through said housing.

6. The portable hydrodynamic cavitation manifold according to claim 2 wherein each said distal end of the first crescent shaped plate of a first baffle is secured to a distal end of a second crescent shaped plate of a second crescent shaped plate in an axially, sinuous and staggered position.

7. The portable hydrodynamic cavitation manifold according to claim 2 wherein said first plate and second plate are secured to each other along said junction point formed at the perpendicular crossing of said first and second plate.

8. The portable hydrodynamic cavitation manifold according to claim 2 wherein adjoining baffles are staggered.

9. The portable hydrodynamic cavitation manifold according to claim 1 wherein said first end of said collection housing includes a removable endcap allowing for the slidable insertion and removal of said first baffle means.

10. The portable hydrodynamic cavitation manifold according to claim 1 wherein said first end of said distribution housing includes a removable endcap allowing for the slidable insertion and removal of said second baffle means.

11. The portable hydrodynamic cavitation manifold according to claim 1 wherein each said outlet aperture is coupled to a 10 barrel/minute Frac tank.

12. The portable hydrodynamic cavitation manifold according to claim 1 including at least one baffle means positioned in said inlet aperture to said distribution housing.

13. The portable hydrodynamic cavitation manifold according to claim 1 wherein said first baffle means extends from said first end to said second end of said collection housing.

14. The portable hydrodynamic cavitation manifold according to according to claim 1 wherein said second baffle means located in said distribution housing is positioned traverse to said inlet aperture.

15. The portable hydrodynamic cavitation manifold according to claim 1 wherein said collection housing and said distribution housing is mounted to a trailer.

16. A portable hydrodynamic cavitation manifold comprising:

a collection housing having a continuous sidewall with a first end and a second end defining an interior chamber therebetween, said collection housing having at least one inlet through said sidewall juxtapositioned to said first end, at least one inlet through said side wall juxtaposition to said second end, and at least one outlet through said sidewall positioned said first and second end;

a first baffle assembly positioned within said first interior chamber and extending between said inlet and said outlet, said first baffle defined as a first crescent shaped plate defined by a proximal end spaced apart from a distal end by a length approximately measuring twice the diameter of said first interior chamber, said first crescent shaped plate have a straight inner edge extending between said proximal and said distal end and a curved outer edge constructed and arranged to conform to an inner diameter of said first interior chamber, said straight inner edge shaped to induce fluid shearing, said first crescent plate having a center width measuring approximately one half the diameter of the inner diameter of said first interior chamber and a second crescent shaped plate forming a mirror image and positioned substantially perpendicular to said first crescent shaped plate; each said plate having at least one flow thru aperture constructed and arranged to form shear inducing angular shaped passageways through each plate;

a removable endcap coupled to one of said first or second ends of said collection housing sized to allow for the slidable insertion and removal of said first baffle assembly;

a distribution housing having a continuous sidewall with a first end and a second end defining a second interior chamber therebetween, said distribution housing having an inlet aperture fluidly coupled to said outlet of said collection housing and a plurality of outlet apertures;

a second baffle assembly positioned within said second interior chamber and traverse each inlet aperture, said second baffle defined as a first crescent shaped plate defined by a proximal end spaced apart from a distal end by a length approximately measuring twice the diameter of said second interior chamber, said first crescent shaped plate of said second baffle assembly having a straight inner edge extending between said proximal and said distal end and a curved outer edge constructed and arranged to conform to an inner diameter of said second interior chamber, said straight inner edge shaped to induce fluid shearing, said first crescent shaped plate having a center width measuring approximately one half the diameter of the inner diameter of said second interior chamber and a second crescent shaped plate forming a mirror image and positioned substantially perpendicular to said first crescent shaped plate within said second interior chamber; each said plate having at least one flow thru aperture constructed and arranged to form shear inducing angular shaped passageways through each plate;

a removable endcap coupled to one of said first or second ends of said distribution housing sized to allow for the slidable insertion and removal of said second baffle assembly; and said collection housing and said distribution housing mounted on a movable vehicle;

wherein fluid introduced through said inlets of said collection chamber is directed through said first baffle assembly for mixing independently, said independently mixed fluids are directed and admixed through said inlet aperture, said admixed fluid is directed through said second baffle assembly for mixing into a homogenous fluid and for distribution through said outlet apertures.

17. The portable hydrodynamic cavitation manifold according to claim 16 wherein each said flow through aperture is sized to control the velocity of fluid flow through said collection housing.

18. The portable hydrodynamic cavitation manifold according to claim 16 wherein each said flow through aperture is sized to provide a predetermined pressure drop for a volume of fluid flow through said distribution housing.

19. The portable hydrodynamic cavitation manifold according to claim 16 wherein each said distal end of the first plate of a first baffle is secured to a distal end of first plate of a second baffle, and said distal end of the second plate of a first baffle is secured to a distal end of a first plate of a second baffle.

20. The portable hydrodynamic cavitation manifold according to claim 16 wherein said first plate and second plate are secured to each other along said junction point formed at the perpendicular crossing of a first and second plate.

21. The device for creating hydrodynamic cavitation in fluids according to claim 16 wherein said baffle assemblies are staggered.

22. The portable hydrodynamic cavitation manifold according to claim 16 including at least one baffle means positioned in said inlet aperture to said distribution housing.

* * * * *